US005149123A

United States Patent [19]

Rohrmoser

[11] Patent Number: 5,149,123

[45] Date of Patent: Sep. 22, 1992

[54] SKI BINDING WITH FRONT AND HEEL JAWS CONNECTED BY A CARRIER PLATE FOR THE SOLE

[75] Inventor: Alois Rohrmoser, Wagrain, Austria

[73] Assignee: Varpat Patentverwertungs AG, Littau, Switzerland

[21] Appl. No.: 833,595

[22] Filed: Feb. 10, 1992

Related U.S. Application Data

[63] Continuation of Ser. No. 483,100, Feb. 22, 1990, abandoned.

[30] Foreign Application Priority Data

Feb. 22, 1989 [AT] Austria ..... 396/89

[51] Int. Cl.[5] ..... A63C 9/081

[52] U.S. Cl. ..... 280/618; 280/633; 280/636

[58] Field of Search ..... 280/616, 618, 620, 628, 280/633, 636

[56] References Cited

U.S. PATENT DOCUMENTS

| | | | |
|---|---|---|---|
| 3,958,811 | 5/1976 | Sittmann | 280/618 |
| 4,082,313 | 4/1978 | Beyl | 280/618 |
| 4,230,338 | 10/1980 | Weigl et al. | 280/618 |
| 4,251,090 | 2/1981 | Weigl | 280/618 |
| 4,505,494 | 3/1985 | Gertsch | 280/618 |
| 4,522,422 | 6/1985 | Jaeger | 280/617 |
| 4,522,424 | 6/1985 | Luitz et al. | 280/633 |
| 4,679,815 | 7/1987 | Pascal et al. | 280/618 |
| 4,709,942 | 12/1987 | Dimier et al. | 280/618 |
| 4,892,326 | 1/1990 | Svoboda et al. | 280/618 |

FOREIGN PATENT DOCUMENTS

| | | | |
|---|---|---|---|
| 674574 | 11/1963 | Canada | 280/618 |
| 1195649 | 6/1962 | Fed. Rep. of Germany . | |
| 7639148 | 4/1977 | Fed. Rep. of Germany . | |
| 2654384 | 6/1977 | Fed. Rep. of Germany . | |
| 3443243 | 6/1985 | Fed. Rep. of Germany | 280/618 |
| 2497109 | 7/1982 | France | 280/618 |

*Primary Examiner*—Andres Kashnikow
*Assistant Examiner*—Brian L. Johnson
*Attorney, Agent, or Firm*—Collard & Roe

[57] ABSTRACT

The invention provides a ski binding comprising a toe piece and a heel piece for retaining a ski boot on a ski, a longitudinal guiding device for at least one of the pieces, the guiding device being affixed to a mounting surface of the ski and the piece being arranged in the guiding device for displacement in the longitudinal direction of the ski. A releasing mechanism is incorporated in each piece and is adjustable to respond to varying releasing forces for releasing the ski boot from the ski. A connecting device interconnects the toe and heel pieces for movement relative to each other, the connecting device including at least two pivotal levers, one of the levers being a connecting element pre-adjustable to a desired length, and respective pivots extending vertically to the mounting surface and connecting the toe piece to the connecting device and the pivotal levers to each other.

8 Claims, 7 Drawing Sheets

SKI BINDING WITH FRONT AND HEEL JAWS CONNECTED BY A CARRIER PLATE FOR THE SOLE

CROSS REFERENCE TO RELATED APPLICATION

This application is a continuation of application Ser. No. 07/483,100 filed Feb. 22, 1990, and now abandoned.

BACKGROUND OF THE INVENTION

1. Field of the Invention

The invention relates to a ski binding with a toe piece and a heel piece, release mechanisms adjustable to varying releasing forces, longitudinal guiding device for the toe piece and/or heel piece which is detachably fastened to the ski, and a connecting element which is connected with the toe piece and/or heel piece by a pivot which extends vertically with respect to a mounding surface of the toe piece and/or heel piece.

2. Description of the Prior Art

U.S. Pat. No 4,522,422 discloses a ski binding including a toe piece and a heel piece to hold a ski boot on a ski. The pieces are provided with a releasing device which, on exceeding predefined forces exerted upon the pieces parallel, transversely and approximately vertically to the ski, permit free movement of retaining devices for the ski boot relative to the ski, so that the ski boot can detach itself from the ski. In this known ski binding, such toe and heel pieces are connected with each other by a connecting element which is elastically deformable in the direction vertically to the ski surface, but is resistant to traction. The toe piece is fixedly secured on the ski or is slidably mounted in a guide extending parallel to the ski, and is able to be fixed in various positions relative to the ski by means of a securing device. The heel piece is slidably mounted in a guide extending parallel to the longitudinal direction of the ski. Owing to the relative movement between the ski, the connecting element connecting the toe and heel pieces and the sole of the ski boot, both in the region of the toe piece and also of the heel piece, supports projecting over the connecting element, or support elements spanning the connecting element in the manner of a bridge, are provided. In addition, suitable sliding surfaces ensure that frictional resistances, which oppose a releasing of the ski boot, are kept low, so that the ski boot can actually detach itself from the ski.

Similar ski bindings have been disclosed in published German patent application No. 2,654,384 and German utility model No. 7,639,148.

German patent No. 1,195,649 discloses a ski binding in which the toe piece is fixedly secured on the ski, and the heel piece is secured on a plate which forms a receiving surface for a sole of the ski boot. At its end facing the toe piece, this plate is connected therewith by a holding arm. This holding arm is secured to the toe piece so as to be secure against rotation, whereas it is articulated to the plate by a pivot pin. In the region of the heel piece, the plate is provided with an elongated slot. In the region of the elongated slot, the plate is guided with a disc-shaped mounting, fixed to the ski, relative to the ski laterally and/or vertically. Upon deflection movements of the plate, in particular short movements in the region of the toe piece, a lateral deviation of the heel piece is brought about, which causes an unsteady mounting of the ski boot on the ski.

SUMMARY OF THE INVENTION

The present invention is designed to provide a ski binding which makes possible a universal adaptation to varying conditions of use, and which does not cause any undesired alterations in the release conditions.

According to the invention, this is accomplished with a ski binding comprising a toe piece and a heel piece for retaining a ski boot on a ski, a longitudinal guiding device for at least one of the pieces, the guiding device being affixed to a mounting surface of the ski and the piece being arranged in the guiding device for displacement in the longitudinal direction of the ski. A releasing mechanism is incorporated in each piece and is adjustable to respond to varying releasing forces for releasing the ski boot from the ski. A connecting device interconnects the toe and heel pieces for movement relative to each other, the connecting device including at least two pivotal levers, one of the levers being a connecting element preadjustable to a desired length, and respective pivots extending vertically to the mounting surface and connecting the toe piece to the connecting device and the pivotal levers to each other.

In such a ski binding, no frictional resistance can build up between the ski boot sole and the connecting element serving as a support for the ski boot, which counteracts the releasing force caused by a relative twisting between the ski boot and the ski in case of a fall or if the ski is caught.

The heel piece comprises a retaining device for the ski boot, and the retaining device is advantageously pivoted to the heel piece for pivoting about an axis extending coaxially to the pivot connecting the toe piece to the connecting device. In this way, the two levers of the connecting element pivot about the same pivot so that the ski boot and the connecting device have the identical movements.

According to one feature of this invention, the ski binding further comprises an adjusting device incorporated in the longitudinal guiding device for adjusting the displacement of the piece whereby the deflection of the retaining device of the toe piece causes the heel piece to be drawn towards the toe piece by the connecting device so that the distance between the heel and toe pieces remains unchanged during the release. In this way, the lateral, vertical or diagonal release of the ski boot is not effected by a change in the distance between the heel and toe pieces but exclusively by the releasing force exceeding the pre-set force of the releasing mechanism.

According to a preferred embodiment, the ski binding comprises respective longitudinal guiding devices for the toe and heel pieces for longitudinal displacement of thereof in said guiding devices, and further comprises an adjusting device coupling at least one of the pieces to the connecting device for longitudinal displacement thereof, optionally a holding tongue coupling the adjusting device to the connecting device, a pivotal arm having one end pivotally coupled to the pivot connecting the pivotal levers to each other for pivoting about an axis extending vertically to the mounting surface, and an opposite end of the pivotal arm being pivoted to the adjusting device for pivoting about an axis parallel to the pivot axis of the one end and between the heel piece and the toe piece immediately adjacent the toe piece. The arrangement of the pivotal arm enables the heel and/or the toe piece to be centered on the ski, as well as the release movements and the pivotal movements of the connecting element. This enables the pivot of the connecting element and the relative adjustment of the toe and heel pieces to be centered on the shin bone of a skier using this ski binding, thus dependably excluding any additional torsion moments which could cause a break of the shin bone.

Preferably, a Cardan joint couples the pivotal arm to the adjusting device so that a deformation of the ski vertically to the mounting surface of the toe and heel pieces on the ski and a lateral deflection of the connecting device is not prevented by a relative movement between the ski boot and the ski.

The Cardan joint may comprise a pivot axis extending vertically to the mounting surface and a pivot axis extending perpendicularly thereto. In this way, during normal skiing without relative lateral movement between the ski boot and the ski, there will only be a relative movement between the ski and the connecting element supporting the ski boot, which extends vertically to the mounting surface of the heel and toe pieces.

Preferably, a guideway extends parallel to the connecting device and slidably supports the Cardan joint, an adjusting arm is connected to the Cardan joint, and an adjusting element connects the adjusting arm to the adjusting device. In this arrangement, the entire unit comprising the toe and heel pieces as well as the connecting device may be adjusted relative to the ski in the longitudinal extension thereof without changing th preset releasing forces and the distance between the toe and heel pieces. This enables the position of the skier on the ski to be changed rapidly to adapt to different skiing conditions, such as hard and soft snow, slalom or giant slalom, downhill run or skiing through deep snow. In this way, the point of gravity of the skier may be repositioned along the length of the ski. Thus, for example, the ski tips may be subjected to a load when the ski binding is moved towards the ski ends and this will avoid the dreaded digging into the snow in a deep snow and will advantageously reduce the steering forces required to steer the ski in deep snow.

According to another embodiment, a further Cardan joint connects the adjusting arm to the connecting device so that a twisting between the toe and heel pieces, which may be caused by a deformation of the ski, cannot disadvantageously change the functioning of the ski binding.

The guiding device may have guide ledges for vertically and laterally guiding the toe and/or heel piece to assure an accurate lateral and vertical position thereof relative to the ski.

Preferably, the connecting element is a shoe support plate on which the sole of the ski boot rests. In this way, relative movements between the ski boot and the shoe support plate will be prevented during the release of the ski boot, and the releasing forces will be fully independent from factors which cannot be predetermined, such as friction between the support surface and the ski boot, and dirt or wear in this area.

The length of the shoe support plate may be adjustable, and means may be provided for adjusting the length and for holding the shoe support plate at the adjusted length to adapt the shoe support plate rapidly and simply to different shoe sizes.

According to another embodiment, the ski binding further comprises sliding elements adjacent the toe and heel pieces, the sliding elements supporting the shoe support plate on the mounting surface of the ski, which makes it possible to avoid undesired tilting movements of the shoe support plate under various operating conditions and, furthermore, prevents freezing of the shoe support plate to the ski.

It is also advantageous to provide adjusting devices respectively connecting the shoe support plate to the heel piece and to the pivot connecting the toe piece to the connecting device because this enables a shoe support plate of one size to be used for various shoe sizes, the distance changes required for larger or smaller shoe sizes being effected by a relative adjustment between the shoe support plate and the toe and/or heel piece..

The longitudinal guiding device may have slits extending vertically to the connecting device whereby the guiding device is deformable in a direction extending perpendicularly to the mounting surface of the ski so that even elongated guiding devices will not disadvantageously hinder the deformation of the ski vertically to the mounting surface of the toe and heel pieces, which is particularly useful if the toe and heel pieces are adjustable as a unit with the connecting element relative to the ski.

According to another embodiment, a pivot supports the longitudinal guiding device on the mounting surface of the ski for pivoting about an axis extending parallel to the mounting surface and transversely to the connecting device to obtain a substantially unhindered, free deformation of the ski relative to the ski binding and, in addition, the pivot between the toe and/or heel piece and the ski enables any tilting and resultant angular displacement between the toe and heel pieces and the ski, caused by the deformation of the ski and its radial alignment relative to the ski boot, to be compensated. Thus, the toe and heel pieces as well as the ski boot always remain in the same relative position, which does not change even during varying deformations, particularly when the connecting element of the ski binding is a shoe support plate.

It is also advantageous if the piece arranged in the guiding device for displacement in the longitudinal direction of the ski comprises guide elements spaced in the longitudinal direction and guiding the piece laterally and vertically in the guiding device for displacement in the longitudinal direction since this will at least considerably reduce an angular displacement between toe and heel piece and the ski boot during strong deformation of the ski, without the use of pivots. The guide elements may be pins or rollers, preferably rollers in needle or ball bearings, which greatly facilitates the relative movements between the toe and/or heel piece and the ski during deflection movements of the toe and heel pieces, thus avoiding disadvantageous influences on the releasing forces.

According to another embodiment of the invention, which stands on its own, the mounting surface is arranged in a recess in an upper surface of the ski. This makes it possible to hold the distance between the sole of the ski boot and the running surface of the ski to a minimum even if the ski binding comprises several pivotal levers and mutually adjustable plates, which assures enhanced streamlining at high speeds, as is important in racing.

The recess may extend only over a longitudinally extending center portion of the ski and may be defined by two longitudinally extending marginal strips projecting above the upper surface. In this way, the reduced stiffness due to the reduced thickness of the center ski portion, which receives the ski binding, is compensated by the marginal strips, thus assuring a more or less unchanged deformation resistance of the ski desired by the manufacturer.

BRIEF DESCRIPTION OF THE DRAWING

For a better understanding of the invention, the latter is explained in further detail hereinbelow in connection with certain now preferred embodiments represented in the drawings, in which.

DESCRIPTION OF PREFERRED EMBODIMENTS

Figure 1A:
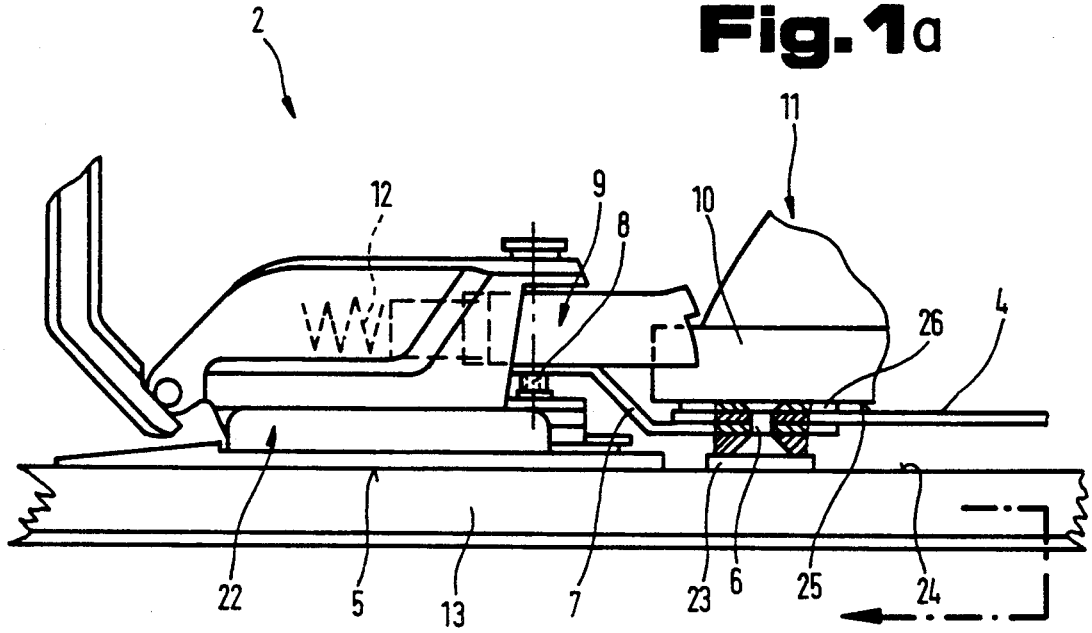
FIGS. 1*a* and 1*b* diagrammatically show a ski in the regions of a toe and heel piece of a ski binding according to the invention in side view and partially in section.

Like reference numerals designate like parts functioning in a like manner in all figures of the drawing.

Figure 1B:
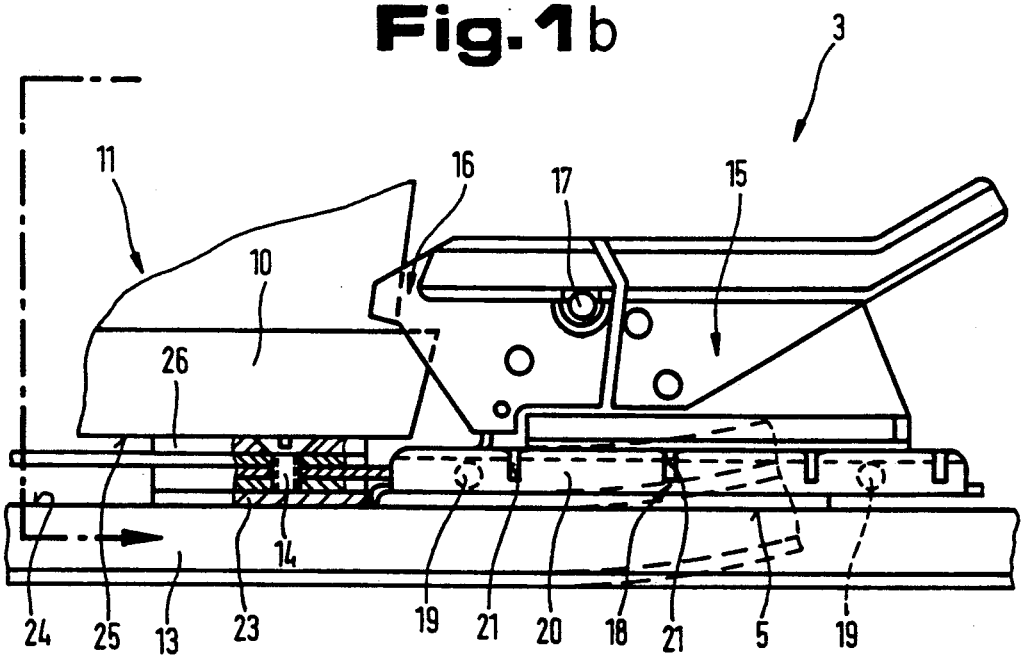
Figure 2:
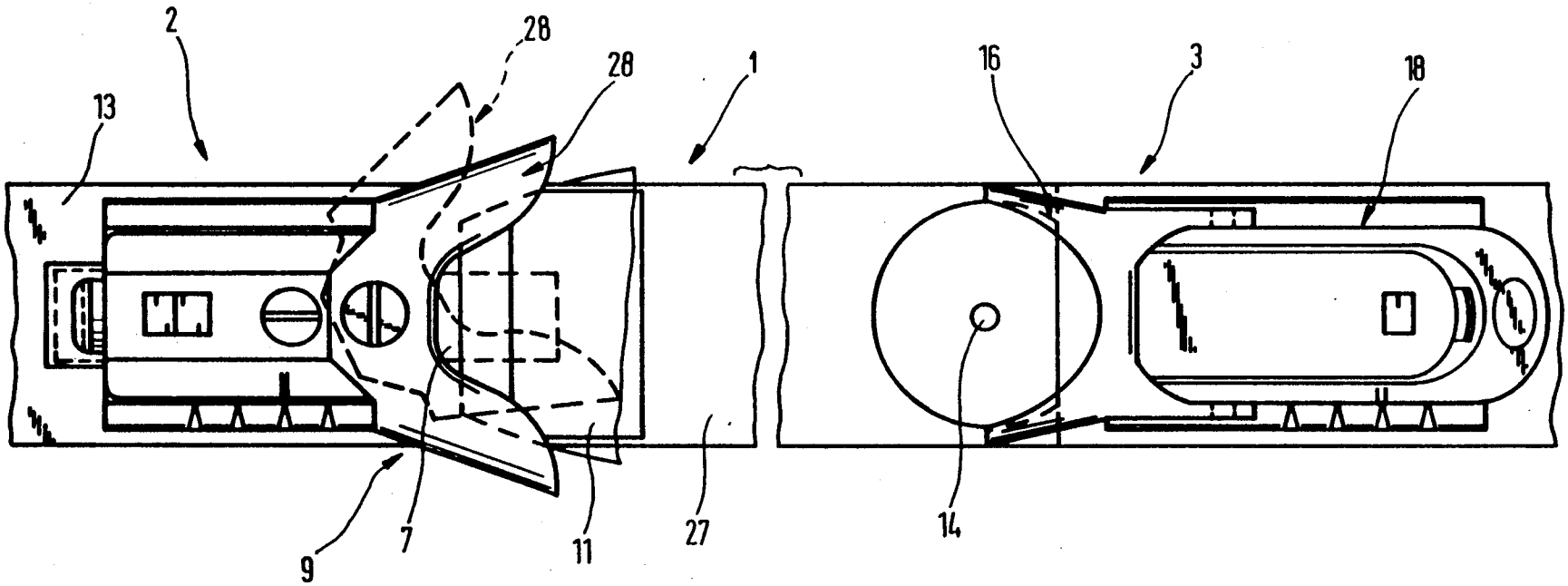
FIG. 2 is a plan view of FIG. 1.

Referring to FIGS. 1*a*, 1*b* and 2, there is shown a ski binding 1 which comprises a toe piece 2 and a heel piece 3. The toe piece and the heel piece are connected by connecting element 4, which is deformable in a direction vertically to a mounting surface 5 of the toe and heel pieces 2, 3, but is rigid and resistant to traction forces in the direction transversely to the ski and in the longitudinal direction between the toe and heel pieces 2, 3.

As shown in FIG. la, pivot 6 couples connecting element 4 to lever 7. The end of lever 7 remote from pivot 6 is likewise rotatably mounted on a pivot 8. Retaining device 9 for a sole 10 of a ski boot 11 is also rotatably mounted on pivot 8. The retaining device 9 may be deflected about pivot 8 against the action of a releasing mechanism 12, represented diagrammatically by a helical spring. Depending on the extent of the deflection movement of the retaining device 9, a previously established releasing force counteracts the movements of the retaining device 9. Hence, upon being subjected to small shocks and corresponding deflection movements, the retaining device may be reset with small forces into the central position, whereas the retaining device 9 will be laterally deflected out of contact with sole 10 when the releasing force is exceeded so that the ski boot 11 is released from the ski binding 1 and the ski boot is no longer held on ski 13.

As shown in FIG. 1*b*, heel piece 3 is linked to connecting element 4 by a pivot 14. Heel piece 3 comprises releasing mechanism 15, which has a predefined releasing force which determines a deflection of retaining device 16, which secures a heel of the sole 10 of the ski boot 11 in its position relative to the ski 13. If this releasing force is exceeded, retaining device 16 will swing up about an axis 17 away from the mounting surface 5 and frees the ski boot 11.

It should be noted that the ski bindings according to the invention are not limited to the toe piece 2 and heel piece 3 illustrated and described herein, but may be used with any type of toe piece and heel piece with horizontal and/or vertical or diagonal release, or release by means of rotary plates.

The illustrated toe piece 2 is fixed in its position relative to the ski 13, whereas the heel piece 3 can move freely along a longitudinal guiding device 18 with respect to the longitudinal direction of the ski 13. The heel piece 3 is guided in the longitudinal guide of the guiding device by guiding elements 19, which are arranged at a distance from each other in the longitudinal direction of the longitudinal guiding device 18. Moreover, the vertical side walls 20 of the longitudinal guiding device 18 are provided with slits 21 running vertically to the mounting surface 5, which slits reduce the moment of resistance of the longitudinal guiding device 18 to deformation, so that it scarcely offers resistance to a deformation of the ski into an upwardly bent position indicated in broken lines in FIG. 1*b*.

Guiding elements 19 enable the heel piece 3 to be readily displaced in longitudinal guiding device 18, even when ski 13 is deformed. Guiding elements 19 may be guide pins, or needle or roller bearings, or rotatable rollers.

In order to now be able to alter the position of ski binding 1 in the longitudinal direction of the ski 13, toe piece 2 may be displaced along a longitudinal guide 22. The adjustment of the toe piece 2 may be effected in accordance with the embodiments disclosed in U.S. Pat. No. 4,522,422 or U.S. Pat. No. 4,522,424, for which reason the details of the adjusting device are not illustrated.

As illustrated, sliding plates 23 support pivots 6 and 14 of the connecting element 4 on an upper side 24 of the ski 13.

Moreover, it is also possible to support a tread surface 25 of the ski boot 11 on the connecting element 4 by sliding elements 26 to enable the boot to be readily released from ski binding 1. These sliding elements 26 may consist of a non-friction material, for example, TEFLON (polytetrafluoroethylene) in order to prevent the tread surface 25 from freezing to the connecting element and to prevent too high a coefficient of friction between the tread surface 25 and the connecting element 4.

FIG. 2 shows that the connecting element 4 may be formed by a shoe support plate 27. Hence in the deflection movements which lead to a turning of the ski boot 11 about the pivot 14, almost no relative movement occurs between the tread surface 25 and the shoe support plate 27, because the latter is deflected approximately about the same point of rotation at pivot 14 as the ski boot 11, which is usually established by the position of the user's shin bone.

Figure 3:
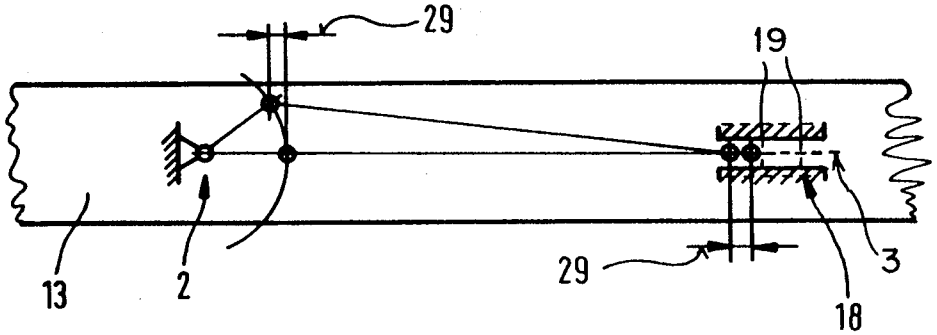
FIG. 3 shows a diagrammatic sketch of the shoe support plate and of a pivotal lever in different positions of the toe piece and the retaining device for the ski boot.

FIG. 2 shows that, with a deflection of retaining device 9 from the position shown in solid lines into a position drawn in broken lines, a support site 28 shifts by an extent 29 in the direction of a tip of the ski 13 (see FIG. 3). Through this indirect increase in the distance between retaining device 16 of the heel piece 3 and retaining device 9 of the toe piece 2, the contact pressure exerted by the heel piece 3 in the direction of the toe piece 2 is reduced, and no undesired release will occur if ski binding 1 is not adjusted exactly, particularly in the case of a safety ski binding. Through the connection of the heel piece 3 with the toe piece 2 by lever 7 and shoe support plate 27, the heel piece 3, which is adjustable relative to the ski 13 in the longitudinal guiding device 18, is likewise displaced by the extent 29 — as shown in FIG. 3 — in the longitudinal direction with respect to the ski 13, so that an undesired release of the ski boot 11 from retaining devices 9 and 16 of the ski binding is prevented.

Compared with the displaceable mounting of the heel piece 3, as also shown diagrammatically in FIG. 3, the toe piece 2 is secured to the ski 13 in a fixed position.

FIGS. 4 to 8 illustrate another embodiment of a ski binding 1. The toe piece 2 and the heel piece 3 are again connected by a connecting element 4 and lever 7 linked by pivots 6, 8 and 14. The toe and heel pieces are arranged at a fixed distance from each other in the longitudinal direction of the ski 13.

In contrast to the first-described embodiment, the toe piece 2 is likewise mounted so as to be freely adjustable in a longitudinal guiding device 30 with respect to the ski 13. For the fixing of the ski binding 1 in the longitudinal direction with respect to the ski 13, a swivel arm 31 is positioned between the connecting element 4 and the ski 13. One end of swivel arm 31 is linked to pivot 6 while its opposite end is coupled by pivot 32 to an adjusting arm 33, which is adjustable in a longitudinal guiding device 34 parallel to the longitudinal direction of the ski 13. For fixing pivot 32 in position, an adjusting device 35 is arranged on the longitudinal guiding device 34, which adjusting device is secured to the ski 13 by fixing screws 36 so as to be immovable in the longitudinal direction. This adjusting device 35 may be formed, for example, by toothed segments adjustable vertically to the surface of the ski 13 by an adjusting screw 37, which toothed segments engage corresponding teeth or recesses in the adjusting arm 33. Furthermore, lateral guide strips 38 and vertical guide strips 39 of the longitudinal guiding device 34 guide a holding tongue 40, connected by pivot 14 with the connecting element 4, laterally and vertically without play. For the positioning and fine adjustment of the distance between the toe piece 2 and the heel piece 3 to produce the necessary contact pressure, the retaining device 16 of heel piece 3 can be repositioned with respect to the holding tongue 40 by an adjusting device 41. The adjusting device 41 has a threaded spindle 42, the screw threads of which engage recesses 43 in the holding tongue 40, and since the holding tongue is connected with the connecting element 4, this adjustment determines the position of the heel piece 3 with respect to the toe piece 2. Accordingly, the releasing force of the releasing mechanism 15 can also be adjusted by means of the adjusting device 41.

Figure 7:
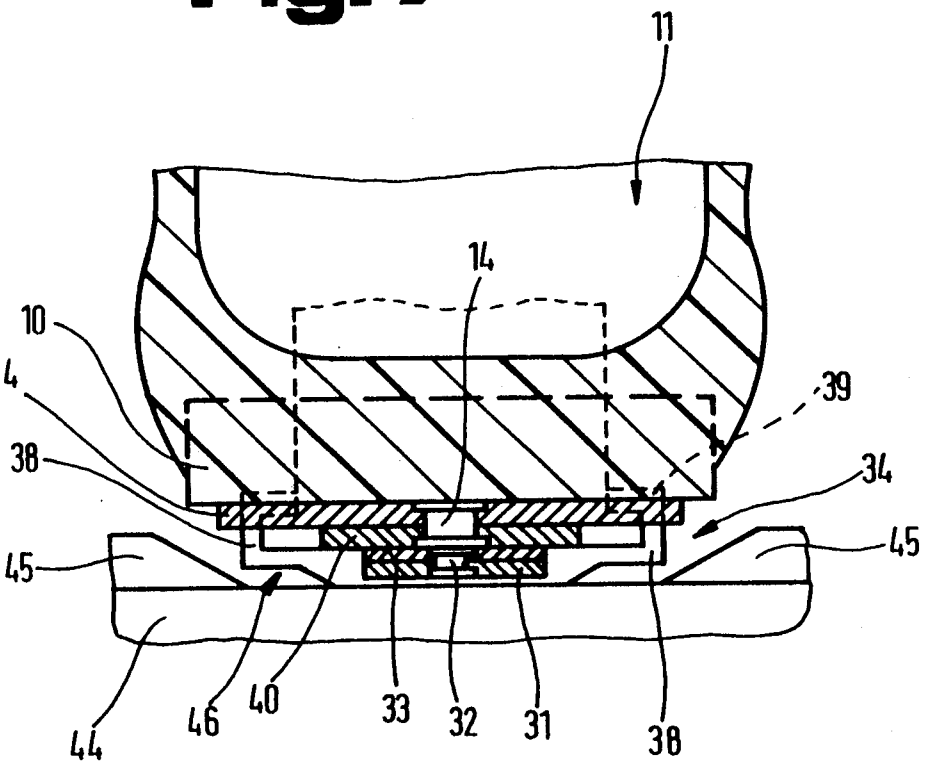
FIG. 7 shows the ski binding of FIG. 5 in section, along lines VII—VII.
Figure 6:
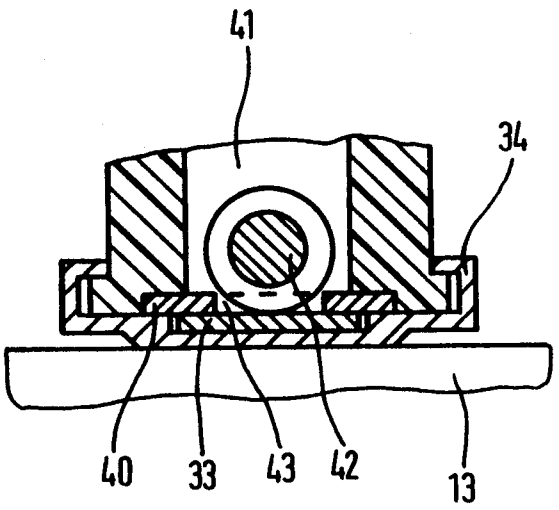
FIG. 6 shows the ski binding of FIG. 5 in section, along lines VI—VI.
Figure 8:
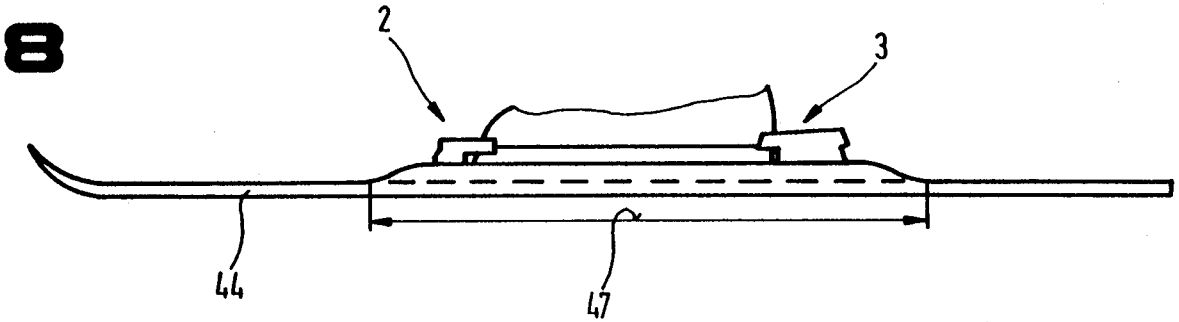
FIG. 8 shows a ski with the ski binding according to FIG. 5 in side view.

As is shown in FIGS. 7 and 8, the ski binding may be mounted on a ski 44 provided with a recess 46 between two marginal strips 45, and the holding tongue 40, the adjusting arm 33 and the swivel arm 31 are mounted on recess 46. As can be seen from FIG. 8, recess 46 may extend over a longitudinal region 47 of the ski 44, which corresponds at least to the maximum distance between the toe piece 2 and the heel piece 3. The height of the marginal strips 45 depends on the height of the individual elements mounted on recess 46.

Figure 4:
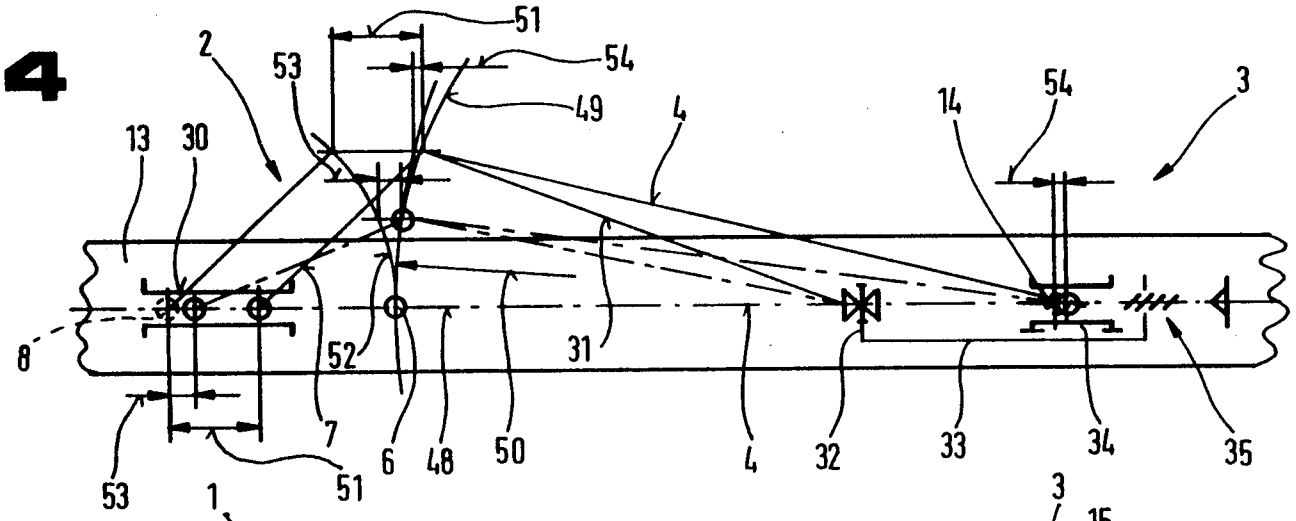
FIG. 4 shows a diagrammatic sketch of the connecting device and of a swivel arm in a ski binding constructed according to the invention, in which the toe and heel pieces are displaceable relative to the ski, with different pivotal positions of the toe piece and its retaining device associated with the ski boot.
Figure 5:
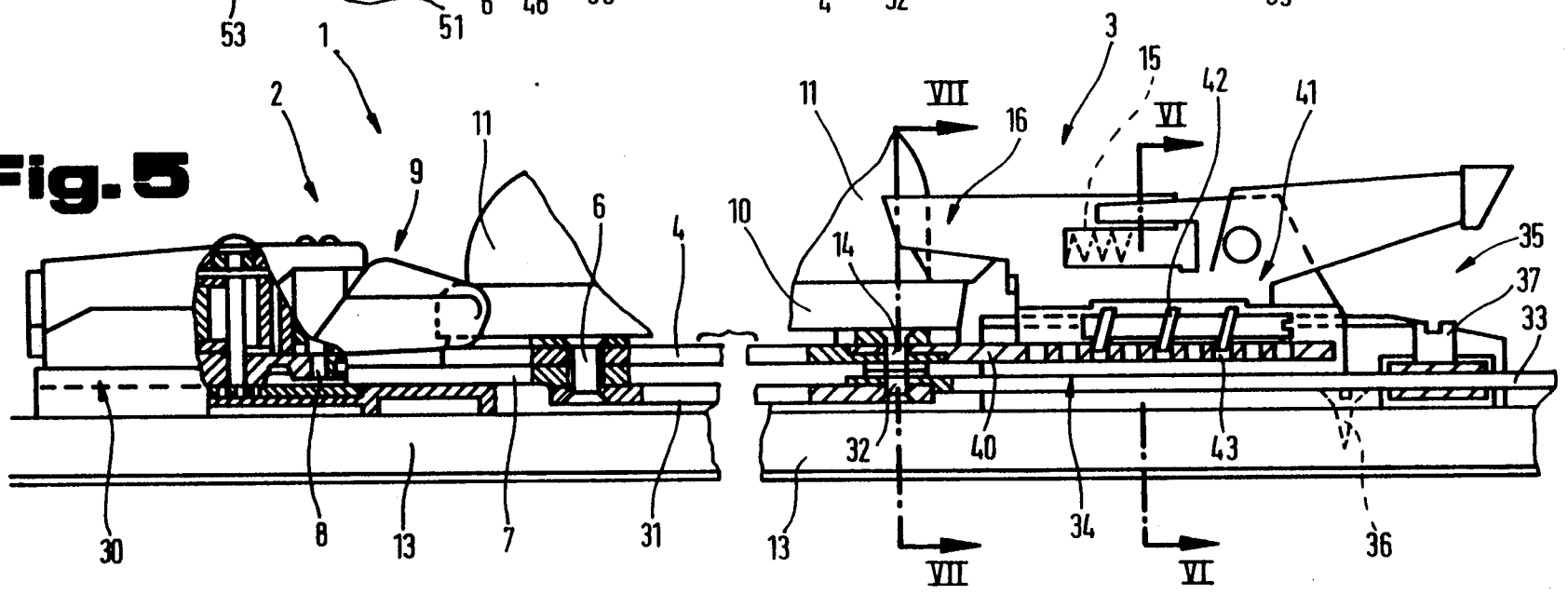
FIG. 5 diagrammatically shows a ski binding constructed according to the invention, in side view with a lever arrangement as shown in FIG. 4, partially in section.

As can be best seen in FIG. 4, on a deflection of the connecting element 4 from the position of rest, in alignment with the longitudinal center axis 48 of the ski, into the positions shown in dot-and-dash and solid lines, the pivot 6 is displaced along a curved path 49 which corresponds to a circular arc with a radius 50. This radius has the same length as swivel arm 31 and corresponds to the distance between the pivot 32 and the pivot 6. Owing to the geometry of the lever arrangement, pivoting of the lever 7 without a connection with the pivot 6 would produce a distance 51 between a path 52 and the path 49 upon deflection of the lever into the position shown in solid lines. This distance 51 is balanced out by a corresponding displacement of the pivot 8 by the very same distance 51 in the direction of the heel piece 3. On a correspondingly smaller deflection, as shown in dot-and-dash lines, a distance 53, by which the pivot 8 is adjusted in the longitudinal direction of the ski 13, is likewise less.

Because of the small distance between the pivot 32 and the pivot 14 only a slight displacement of the heel piece 3 by a distance 54 occurs even with considerable deflection of the connecting element 4 drawn in solid lines. This articulation of the connecting element 4 has the advantage that the connecting element 4, which is loaded with the weight of the skier, does not have to be displaced relative to the ski 13, but rather the toe piece 2, which is unloaded, is drawn against the ski boot 11, so that the distances 51, 53 and 54, between the toe piece 2 and the heel piece 3, cannot have a disadvantageous effect on the secure functioning of the ski binding 1, and above all cannot lead to any faulty releases.

Figure 9:
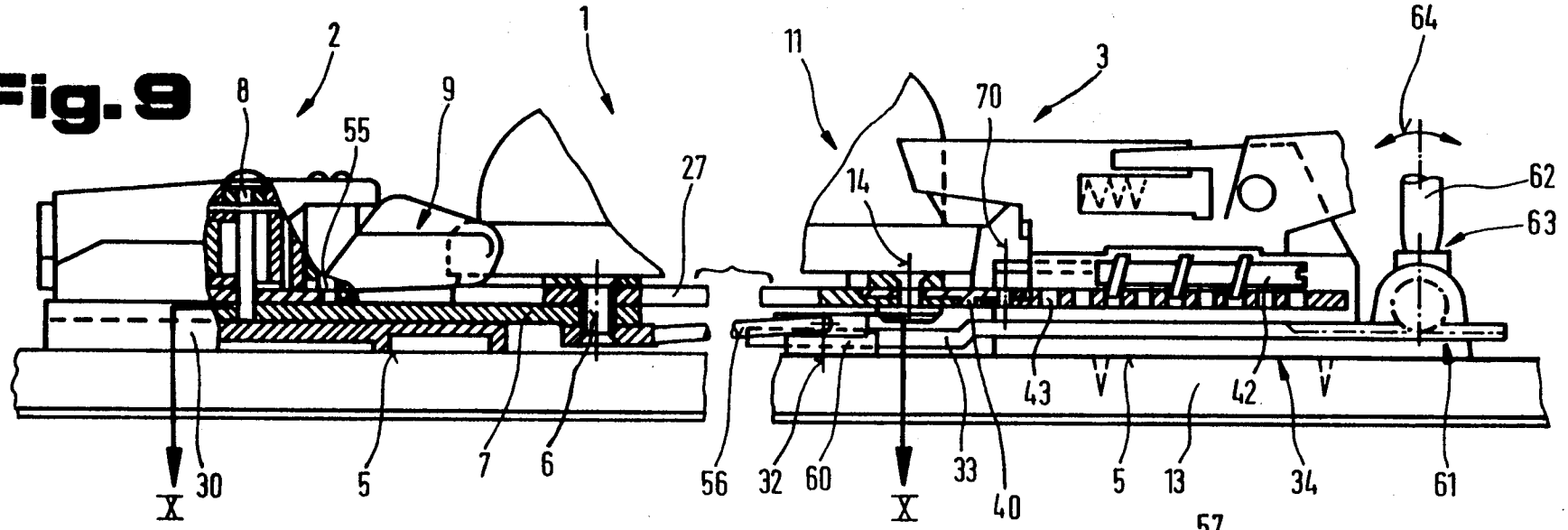
FIG. 9 diagrammatically shows another embodiment of a ski binding constructed according to the invention, with Cardan joints between the swivel arm and the adjusting arm in side view and partially in section, with a toe piece which has a double joint.
Figure 10:
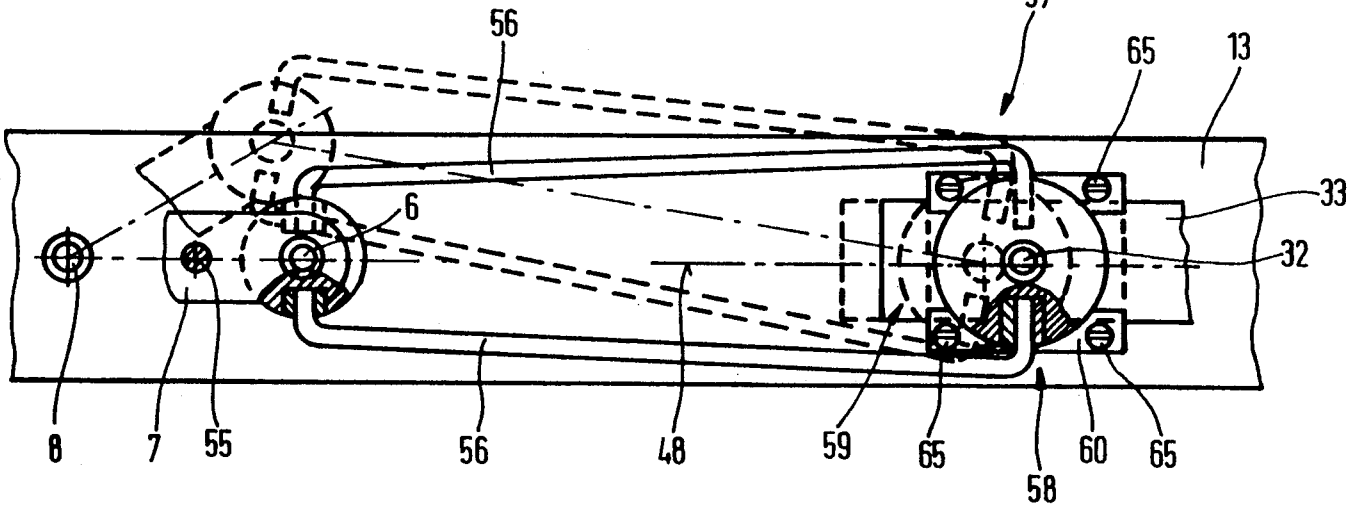
FIG. 10 diagrammatically shows the arrangement of the swivel arm and lever, with removed shoe support plate, of the ski binding of FIG. 9.

FIGS. 9 and 10 show yet another embodiment of a ski binding 1, in which the toe piece 2 and the heel piece 3 are connected by means of a shoe support plate 27 on which a ski boot 11 is supported. Additionally, the toe piece 2 is so constructed that the retaining device 9 may be pivoted about a pivot 55, while the entire toe piece 2 may be deflected about pivot 8. The pivot 8 also supports lever 7. The retaining device 9 is therefore adjustable if necessary, under support by its own damping element, which may be a helical spring or the like, relative to and independently of pivot 8 and the rotations of the toe piece 2 and the pivot 8. The toe piece 2 and the heel piece 3, as has been explained in connection with the previously described embodiments, are adjustable along longitudinal guiding devices 30 and 34, respectively, relative to the ski 13 in the longitudinal direction thereof.

Swivel arms 56 are provided to hold the toe piece 2 and the heel piece 3 in their position relative to the ski 13. These swivel arms 56 are adjustable by means of a Cardan joint 57 about pivot 32 extending vertically to the mounting surfaces 5 of the toe piece 2 and heel piece 3, which pivot forms one of the Cardan axes, while the Cardan axes 58 extending perpendicularly thereto are formed by ends of the swivel arms 56 bent towards each other. Such a construction ensures that, independently of the pivotal position of the swivel arms 56 with respect to a longitudinal central axis 48, a relative adjustment between the ski 13 and the shoe support plate 27 is possible, free of impediment. Hence, even in the case of extreme flexures of the ski 13, the ski binding 1 may be securely held and positioned on the ski. The pivot 32 is arranged in a sliding carriage 59, which is adjustable along a stationary guiding device 60 parallel to the longitudinal direction of the ski 13. An adjusting arm 33 serves for the mounting and adjusting of the sliding carriage 59 in the longitudinal direction of the ski 13, which arm is secured in a ratchet device 61 on the side of the heel piece 3 remote from the toe piece 2. A ski pole 62 may be inserted in an opening 63 of the ratchet device 61 and, by alternating movement of the ski pole 62 in the directions indicated by a double arrow 64, the entire ski binding 1 can be adjusted in the longitudinal direction with respect to the ski 13 either in the direction of the heel piece 3 or in the direction of the toe piece 2.

The guiding device 60 may be fixedly secured o the surface of the ski 13 by means of a fixing device 65, for example screws.

Figure 11:
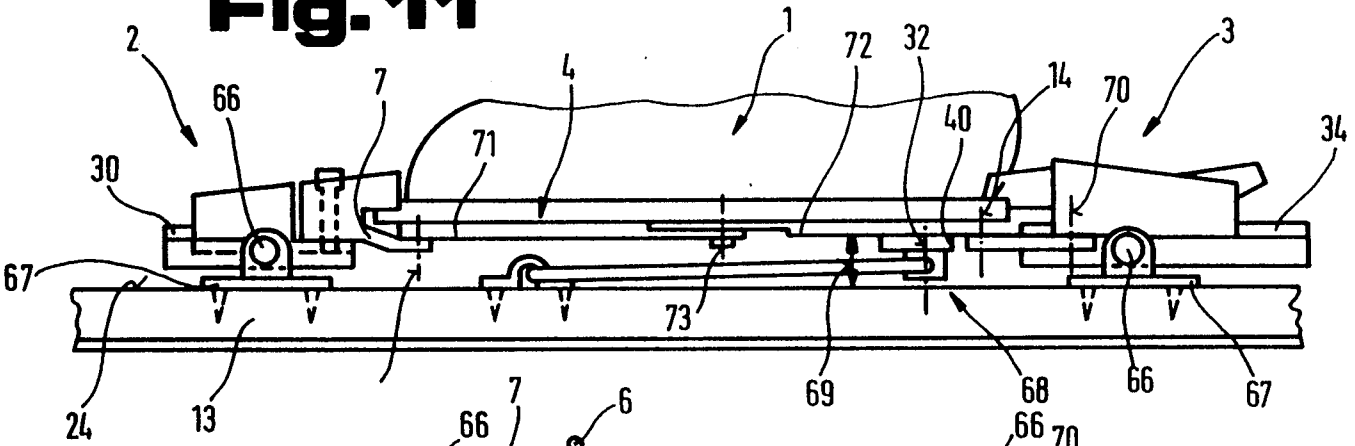
FIG. 11 diagrammatically shows a ski binding constructed according to the invention, with toe and heel pieces supported by means of joints on the ski, in side view.
Figure 12:
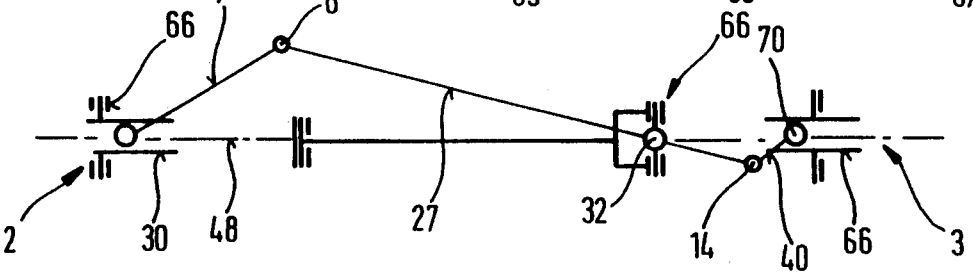
FIG. 12 shows a diagrammatic sketch of the lever arrangement in the ski binding shown in FIG. 11, with laterally pivoted toe piece retaining device of the toe piece.

The embodiment illustrated in FIGS. 11 and 12 differs from those described previously in that the toe piece 2 and the heel piece 3 may be pivoted about pivot axes 66 extending parallel to the upper side 24 of the ski 13 and transversely to its longitudinal direction. Pivot axes 66 are secured in bearing blocks 67. In this way, the relative position of the toe and heel pieces 2, 3 is maintained when the ski 13 is deformed because the relative displacement between the heel piece 3 and the ski 13 is compensated by pivoting about axis 66. Moreover, the toe and heel pieces 2, 3 are adjustable in a longitudinal guiding device 30 and 34, respectively, independently of the ski 13, in its longitudinal direction. The connection between the toe piece 2 and the heel piece 3 takes place by means of the lever 7, the connecting element 4 and the holding tongue 40. To enable the shoe support plate 27, forming the connecting element 4, to rotate about pivot 32, i.e. approximately the shin bone, a Cardan joint 68 is provided, which always keeps the shoe support plate in alignment with the longitudinal central axis 48, independently of a distance 69 between the upper side 24 of the ski 13 and the shoe support plate 27. In this way, the shoe support plate 27 swivels in opposite directions in relation to the longitudinal central axis 48. In order to make this possible without jamming the heel piece 3 and the toe piece 2 in their longitudinal guiding devices, the holding tongue 40 is articulated by pivot 14 to shoe support plate 27, and by further pivot 70 to the heel piece 3, while the toe piece 2 is connected by lever 7 and pivot 6 with the shoe support plate 27. This enables the ski boot 11 to be guided in the region of the toe piece 2 and the heel piece 3.

It should be noted that, whenever pivot 32 is spaced from pivot 14 in the longitudinal direction of the ski, a holding tongue 40 is provided, as hereinabove described. If pivot 70 is omitted, the part connected with the strip having recess 43 would have to be provided with a slot extending transversely to the longitudinal direction of the ski, to receive the pivot 14.

It should also be noted that it is possible to connect the shoe support plate 27, i.e. the connecting element 4, with the surface of the ski 13 by means of an elastic and freely deformable synthetic resin material or, in the region of the side edges of the shoe support plate 27 and of the ski 13, to provide bellows or elastic covers to prevent ice, snow or humidity from penetrating between the shoe support plate 27 and the upper side of the ski 13, which could lead to an impediment to the free movement of the various transmission members such as levers, arms and the like.

It is also possible to arrange damping devices both in the region of the longitudinal guiding devices 18, 30 and 34, and between the latter and the connecting element 4 as well as the toe and heel pieces 2, 3 and the remaining transmission elements, so that the relative movements between the ski 13 and the ski binding 1 can be optimally damped. In addition, it is also possible to arrange a damping device between the shoe support plate 27 and the upper side of the ski 13, for example an elastically deformable synthetic resin material or a rubber packing. These damping devices may also be springs and the like.

As known, it is also possible to adjust the distance between the toe piece 2 and the heel piece 3 to adapt the ski binding to differing shoe sizes, before the fine adjustment takes place by means of the releasing mechanisms 12 and 15. As such adjusting devices are known in many embodiments, a detailed illustration has been dispensed with. It is merely indicated diagrammatically in FIG. 11 that the shoe support plate may consist of two parts 71 and 72, which can be connected in different relative positions with respect to each other by means of a fixing element 73.

Figure 13:
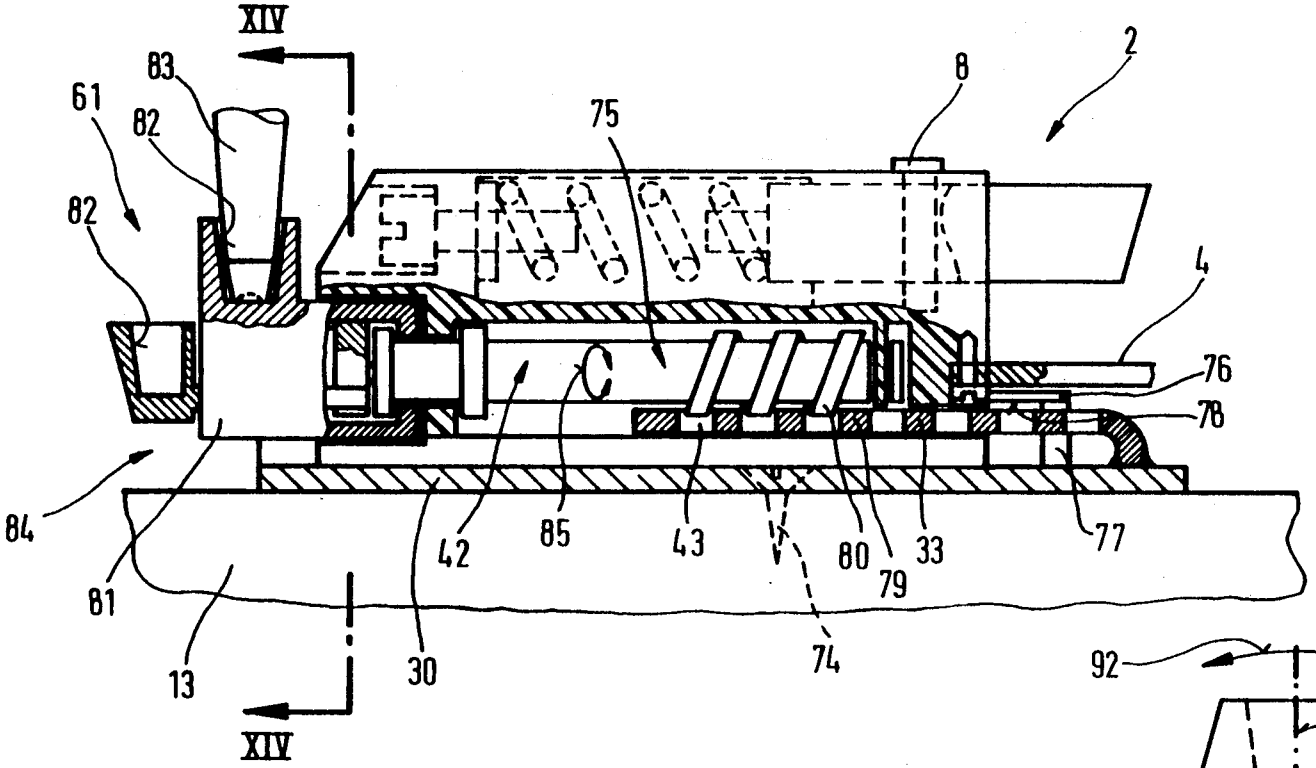
FIG. 13 diagrammatically shows an embodiment of an adjusting device for a binding unit consisting of toe piece, connecting element and heel piece, as well as a swivel arm, for the adjustment relative to the ski, in side view and partially in section.
Figure 14:
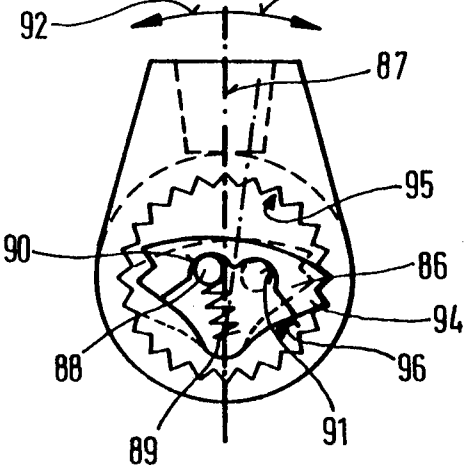
FIG. 14 shows the adjusting device according to FIG. 13 in front view along lines XIV—XIV of FIG. 13.

FIGS. 13 and 14 illustrate the ratchet device 61 for th adjustment of the entire ski binding 1 by its displacement relative to the adjusting arm 33. This ratchet device 61 positively displaces toe piece 2 and heel piece 3, connected therewith by the connecting element 4, relative to the ski 13. Longitudinal guiding device 30 is attached to ski 13 by fastening screws 74, and toe piece 2 (this could, however, just as well be the heel piece 3) is displaceably mounted in device 30. A housing 75 of the toe piece 2 is guided laterally and vertically by means of vertical guide strips 76 and lateral guide strips 77, the vertical guide strips 76 resting on shoulders 78 of the housing 75 and pressing the housing with the threaded spindle 42 arranged therein in the direction of a detent strip 79 which is movably connected with the longitudinal guiding device 30, so that spindle thread 80 engages recesses 43 of the detent strip 79. The actuating member 81 of ratchet device 61 has a receiving opening 82 for a ski pole 83. By pivoting the actuating member 81 with the ski pole 83, depending on the position of a switching device 84, which may likewise be actuated by the ski pole 83 by inserting the ski pole 83 in a receiving opening 82, the threaded spindle 42 will be moved in one of the two directions shown in the drawing by a double arrow 85. The switching device 84 adjusts a sliding block 86 which is arranged inside the ratchet device 61 and pivotal about a tilting axis 87 by rocking lever 88, which is biassed by spring 89 into one of two recesses 90, 91. In this way, the sliding block 86 is adjusted into a position in which, on a movement in the direction of an arrow 92, it can yield through the action of the spring 89, and consequently makes possible a relative movement between the actuating member 81 and the threaded spindle 42. In the opposite direction, indicated by arrow 93, teeth 94 engage an internal toothing 95 and, since a rotation of the sliding block 86 is prevented by a stop 96, the threaded spindle 42 is turned. If the rocking lever 88 is pivoted by means of the switching device 84 so that it engages the recess 91, a free movement of the actuating member 81, actuated by the ski pole 83, is possible in the direction of the arrow 93, and the actuating member 81 and the threaded spindle 42 are rigidly connected on turning in the direction of the arrow 93.

Hence, using this adjusting device formed by a ratchet device 61, it is possible to adjust the entire unit, consisting of the toe piece 2, heel piece 3 and the connecting element 4, in any desired direction along the ski 13.

I claim:

1. A ski binding comprising a toe piece and a heel piece, the pieces respectively comprising a device for retaining a toe of a ski boot and a device for retaining a heel of the ski boot on a longitudinally extending ski, the retaining devices being pivotal about respective pivots on the toe and heel pieces, one of the pieces being secured to a mounting surface of the ski in a longitudinally fixed position, a longitudinal guiding device for the other piece, the guiding device being affixed to the mounting surface of the ski and other piece being mounted in the longitudinal guiding device for free longitudinal displacement, respective releasing mechanisms arranged to pivot the retaining devices and thereby to release the toe and heel of the ski boot from the retaining devices in response to an adjustable releasing force, a connecting device interconnecting the toe and heel pieces for longitudinal movement of the other piece relative to the one piece while the connecting device has a fixed length, the connecting device including a longitudinally extending connecting element having opposite ends linked to vertical pivots supported on the mounting surface of the ski, the one piece being linked to one vertical pivot at a first end of the connecting element, and a lever having opposite ends linked to the pivot of the retaining device of the one piece and to the one vertical pivot at the first end of the connecting element.

2. The ski binding of claim 1, wherein the pivot for the retaining device of the one piece extends vertically while the pivot for retaining device of the other piece extends horizontally.

3. The ski binding of claim 1, further comprising sliding element supporting the vertical pivots on the mounting surface of the ski adjacent the toe and heel pieces.

4. The ski binding of claim 1, wherein the longitudinal guiding device has vertically extending slits whereby the guiding device is deformable in a direction extending perpendicularly to the mounting surface of the ski.

5. The ski binding of claim 1, wherein the other piece comprises longitudinally spaced guide elements guiding the other piece in the guiding device for longitudinal displacement therealong.

6. The ski binding of claim 1, wherein the connecting element is a support plate for the ski boot.

7. The ski binding of claim 6, wherein the length of the support plate is pre-adjustable, and further comprising means for pre-adjusting the length and for holding the support plate at the pre-adjusted length.

8. The ski binding of claim 1, comprising a further longitudinal guiding device for the one piece, the guiding device being affixed to the mounting surface of the ski and the one piece being mounted in the longitudinal guiding device for longitudinal displacement to a pre-adjusted fixed position.

* * * * *